United States Patent [19]

Burnham

[11] 4,014,470

[45] Mar. 29, 1977

[54] CONICAL SPRAY NOZZLE

[75] Inventor: Richard C. Burnham, Greenfield, Mass.

[73] Assignee: Bete Fog Nozzle, Inc., Greenfield, Mass.

[22] Filed: Mar. 1, 1976

[21] Appl. No.: 662,834

[52] U.S. Cl. ..... 239/472; 239/487

[51] Int. Cl.[2] ..... B05B 1/34

[58] Field of Search ..... 239/466, 472, 487, 488, 239/489, 486, 590, 590.3, 590.5

[56] References Cited

UNITED STATES PATENTS

| | | | |
|---|---|---|---|
| 1,101,264 | 6/1914 | Eneas | 239/472 X |
| 1,282,175 | 10/1918 | Binks | 239/488 X |
| 1,310,687 | 7/1919 | Binks | 239/488 X |
| 2,027,954 | 1/1936 | Barclay | 239/472 |

*Primary Examiner*—John J. Love

*Attorney, Agent, or Firm*—Chapin, Neal and Dempsey

[57] ABSTRACT

A full cone spray nozzle, particularly for liquids bearing fibrous particles and the like, having a pair of swirl imparting vanes within the bore of the nozzle. Transversely of the bore, the vanes are approximately semi-circular segments, each having a central recess to provide an opening for liquid flow in axial alignment with the outlet orifice of the nozzle. The vanes overlap circumferentially on diametrically opposite sides of the opening. In the direction of liquid flow, each semi-circular segment is generally sinusoidal, having a convex loop in one quadrant of the passage facing upstream and a concave loop also facing upstream in an adjacent quadrant of the passage. The curved loop portions of each vane are interconnected by an axially extending leg which cross at about the center of the bore and being recessed define the central opening.

7 Claims, 5 Drawing Figures

CONICAL SPRAY NOZZLE

BACKGROUND

Whirling spray nozzles of various types have been known for many years wherein a vortex motion is imparted to a liquid passing through the nozzle to produce a conical spray. It has been the general practice to utilize vanes of various construction within such nozzles to impart a vortical component of motion to the liquid. Nozzles of this type have been used for spraying a slurry or liquid containing a solid or particulate phase. Prior patents relating to these types of nozzles include the following U.S. Pat. Nos. 1,309,597, 1,503,438, 2,747,936, 2,751,252, 3,275,248, 3,567,116 and 3,666,183. In general, while these patents disclose the use of vanes which impart a whirling motion to the liquid, they are not suitable for spraying a slurry in which the solid phase is composed of relatively larger particles and especially long, rough fibers as in the case of cellulose fibers used in the papermaking process. Such fibers have a great tendency to snag on the edges of the whirl vanes and to agglomerate because of their length and rough outer surface characteristics. Consequently, nozzle clogging readily occurs requiring relatively frequent equipment shutdowns.

It is the principal object of this invention to provide an improved vortex spray nozzle for a fibrous slurry which provides for uniform particle dispersion while overcoming the clogging tendency of spray nozzles heretofore available.

It is a further object of this invention to provide a nozzle of the above type which has maximum free passage or opening through the swirl imparting vanes whereby it is uniquely adapted for use in the papermaking industry where fibrous slurries are sprayed.

The above and other objects and advantages of this invention will be more readily apparent in connection with the following description and the accompanying drawings, in which.

Figure 1:
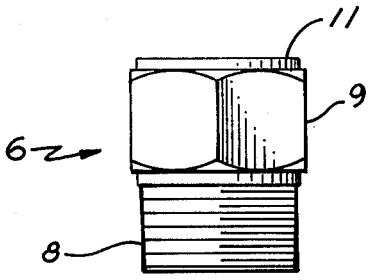
FIG. 1 is an elevational view of a spray nozzle of the type embodying this invention.
Figure 2:
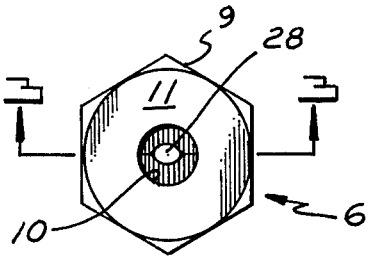
FIG. 2 is a plan view of the nozzle of FIG. 1.

Referring in detail to the drawings, a spray nozzle 6 of the type embodying this invention may be a tubular unitary body of any desirable external configuration. As shown, the nozzle is externally threaded at its inlet end 8 and a polygonal drive flange 9 is provided for engagement by a wrench when it is desired to tighten the nozzle in a threaded fitting. The outlet end of the nozzle has a central orifice 10 of cylindrical configuration which extends through the outer end wall 11 of the nozzle and intersects with conical surface 12 (FIG. 3), which constitutes the upper wall of a mixing or outlet chamber 14. The outlet chamber is also defined by the inner diameter or cylindrical bore 16 of the nozzle.

Swirl imparting means are provided by transversely extending segmental vanes 18 and 20 which separate the mixing chamber 14 from inlet chamber 22 whose inner wall 24 is a continuation of bore 16.

Liquid slurry under pressure, such as waterborne cellulose fibers, is supplied to the inlet end of the nozzle. Within the inlet chamber 22, the slurry moves within the confines of the bore 16 as a column or single stream until contacting the vanes 18 and 20 where the liquid column is separated into two streams or portions. One stream is annular, the other axial. A swirling movement is imparted to the outer peripheral or annular stream of the slurry as it passes over the surface of the vanes 18 and 20, while the central portion of the slurry passes more or less directly through central opening 28 formed by the vanes. In the upper chamber 14, the vortical stream caused by the vanes 18 and 20 and the axially moving stream reunite and mix together, thereby providing for uniform fiber dispersion in the liquid phase. The central opening 28 of the vanes has an open area approximately 5–20 percent of the area of the outlet orifice 10, depending upon the desired distribution of emitted liquid in the spray pattern. This relationship insures thorough mixing of the slurry in the outlet chamber while the generally elliptical configuration of orifice 28 is capable of passing relatively long fibers. In addition, this mixing is enhanced by the dimensional relationship of the outlet orifice 10 to the much larger cross sectional diameter of the chamber 14 and conical upper surface 12.

Vanes 18 and 20 comprise two generally semi-circular segments (FIG. 4), when viewed in the direction of fluid flow through the nozzle. As shown at 22, the vanes overlap circumferentially to some extent on diametrically opposite sides of the opening 28 to insure against direct axial flow of the annular portion of the flow pattern. Such flow would disrupt the vortex flow imparted by the vanes to the outer stream of the liquid column. Each vane 18 and 20 has an identical arcuate recess 24 (FIG. 3), provided along its inner edge, by which the generally elliptical central opening 28 is formed.

Figure 3:
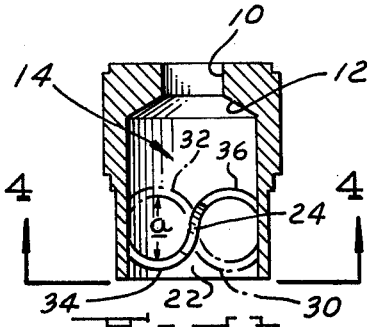
FIG. 3 is a view taken along line 3—3 of FIG. 2.
Figure 4:
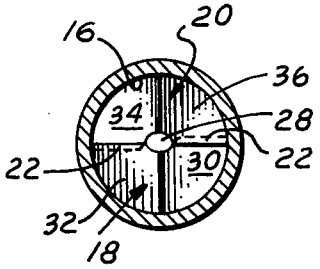
FIG. 4 is a bottom view as seen from line 4—4 of FIG. 3.
Figure 5:
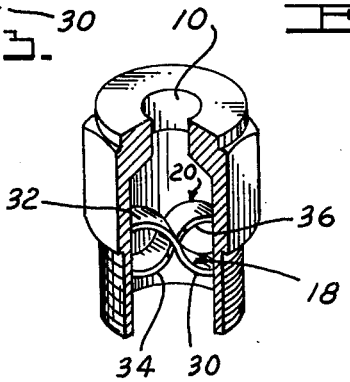
FIG. 5 is a perspective view partly in section of the spray nozzle shown in FIG. 1.

Viewed in the direction of fluid flow (FIG. 4), semicircular vane 18 has a convex lobe 30, in one quadrant of the passage facing upstream and a concave lobe 32 in the adjacent quadrant. Similarly, vane 20 has a convex lobe 34 in a quadrant of the passage diametrically opposite convex lobe 30 of the disc 18 and a concave lobe 36 in a quadrant diametrically opposite concave lobe 32 of the disc 18. The vanes are thus approximately sinusoidal and, as best seen in FIG. 3, the cylindrically curved lobe portions of each sinusoidal vane are interconnected by axially extending leg portions which cross at about the center of the nozzle bore and being recessed as at 24 form the central flow opening 28.

It will be noted that the two sinusoidal vanes are juxtaposed in edge-to-edge relation defining a figure "8" which extends horizontally across the bore of the nozzle. The two semi-cylindrical limbs of each loop of the figure 8 are offset from one quadrant to the adjacent quadrant of the bore and thus provide an unobstructed opening facing transversely of the nozzle bore of diameter *a* (FIG. 3) sufficient to permit free passage therethrough of a sphere or ball having a diameter approximately equal to the diameter *a*. The dimension *a*, known as the "free passage diameter" lies in a radially extending plane of the nozzle and is approximately equal in the diameter of the orifice 10. The significance of this relationship is that any particulate material in a slurry or contaminated liquid which is capable of passing through the outlet orifice 10 is also capable of passing through the two radially-oriented, unobstructed openings defined by the loops of vanes 18 and 20. It is important, moreover, that the cross sectional area of the bore 16 be approximately 5–6 times the area of the orifice 10. Furthermore, the free passage diameter *a* should be preferably equal to about 47 percent of the diameter of the bore 16.

Slurry received by the nozzle will be in columnar form until encountering the diametrically opposite convex cylindrical upstream lobes 30 and 34 where the outer portion of the liquid column will follow a circular path from these convex lobes to the concave lobes located downstream from the first lobes. From the concave lobes, the liquid flows transversely through the radially oriented openings *a* from which it impinges to some extent against the downstream or orifice facing sides of the axially extending leg portions of the vanes. The axially and transversely oriented leg portion of the vanes impart an axial component motion to the fluid flow which issues through the vane openings *a*. The rotary and axial components of motion thus imparted to the annular stream of liquid results in the liquid having a vortical or whirling motion as it moves toward orifice 10.

In addition to the vortical motion imparted by the vanes 18 and 20, part of the column of inlet water passes directly through the generally elliptical central opening 28. Due to the fact that there is some overlap 22 in the diametrically opposed outer ends of the two discs, as indicated at 22, this axial flow is wholly confined to the central portion of the flow. There is, of course, some interference at the interface of the axial and annular vortical flows. These diverse flow patterns cause thorough mixing of the slurry in the upper chamber of the nozzle 14 with resulting uniformity of dispersion of the fibers in the liquid medium. In the upper chamber, the conical surface 12 adjacent the orifice 10 insures against the slurry particles or fibers becoming lodged in any corner of the nozzles and further contributes to the formation of a conical spray which is emitted by the orifice 10.

Having thus described the invention, what is claimed is:

1. Full cone spray nozzle comprising a fluid conduit having an outlet orifice, vane means within said conduit for imparting a vortical component of motion to liquid flowing therethrough, said vane means having an opening therethrough transversely of the conduit which is substantially smaller than the outlet orifice and is in axial alignment therewith, said vane means including sinusoidal portions in edge-to-edge relation spanning adjacent semi-circular segments of the conduit, each sinusoidal portion including convex and concave lobes interconnected by axially extending leg portion, said convex lobes being disposed toward the inlet end of the conduit and the concave lobes being offset axially from the convex lobes a distance at approximately equal to the diameter of said orifice, said convex and concave lobes being in alternate circumferential sequence in said conduit.

2. Full cone spray nozzle as set forth in claim 1 in which a spherical ball having a diameter approximately equal to the diameter of the outlet orifice is capable of passing between the axially offset lobes of said vane means.

3. Full cone spray nozzle as set forth in claim 2 in which the diameter of said ball is approximately 47 percent the diameter of said conduit.

4. Full cone spray nozzle as set forth in claim 1 in which said sinusoidal portions have circumferentially overlapping outer edge portions and in which adjacent edges of said leg portions are recessed to form the opening through said vane means.

5. Full cone spray nozzle as set forth in claim 4 in which said leg portions cross in edge-to-edge relation centrally of the conduit, the opening formed by said leg portions having an area 5–20 percent the area of the outlet orifice.

6. Full cone spray nozzle as set forth in claim 4 in which the cross sectional area of said conduit is approximately 5–6 times the area of the outlet orifice.

7. Full cone spray nozzle comprising a fluid conduit having an outlet orifice, a pair of axially coextensive, sinusoidal vanes disposed within said conduit in edge-to-edge relationship, each vane spanning about half the cross sectional area of the conduit, and having convex and concave lobes with an interconnecting axially extending leg portion, said leg portions crossing at the center of the conduit, the adjacent edge of each leg portion being recessed to provide a generally elliptical opening in axial alignment with said outlet orifice and being of substantially smaller diameter than said orifice, said vanes having circumferentially overlapping edge portions disposed on diametrically opposite sides of the opening, the convex lobes of each leg being adjacent the inlet end of the nozzle and the concave lobes being axially spaced downstream a distance about equal to the diameter of the outlet orifice.

* * * * *